United States Patent [19]

Kaneko et al.

[11] 4,297,437

[45] Oct. 27, 1981

[54] PROCESSING METHOD OF SILVER HALIDE COLOR PHOTOGRAPHIC MATERIAL

[75] Inventors: Yutaka Kaneko; Shigeto Hirabayashi; Satoshi Kawakatsu; Hidetaka Ninomiya, all of Hino, Japan

[73] Assignee: Konishiroku Photo Industry Co., Ltd., Tokyo, Japan

[21] Appl. No.: 209,582

[22] Filed: Nov. 24, 1980

[30] Foreign Application Priority Data

Nov. 22, 1979 [JP] Japan ..... 54-151511

[51] Int. Cl.[3] ..... G03C 7/00

[52] U.S. Cl. ..... 430/376; 430/380; 430/399; 430/405; 430/505; 430/566

[58] Field of Search ..... 430/380, 399, 405, 505, 430/566, 376

[56] References Cited

U.S. PATENT DOCUMENTS

| | | | |
|---|---|---|---|
| 3,342,599 | 9/1967 | Reeves | 430/566 |
| 3,647,462 | 3/1972 | Surash | 430/399 |
| 3,869,288 | 3/1975 | Godowsky | 430/405 |
| 4,108,663 | 8/1978 | Tanaka et al. | 430/566 |

*Primary Examiner*—J. Travis Brown

*Attorney, Agent, or Firm*—Bierman & Bierman

[57] ABSTRACT

A method for processing an exposed color photographic material containing a color developing agent or precursor by developing with a color developer which is replenished.

4 Claims, 4 Drawing Figures

PROCESSING METHOD OF SILVER HALIDE COLOR PHOTOGRAPHIC MATERIAL

The present invention relates to a processing method applied to the photographic silver halide material, and particularly to a color development processing method that requires less quantity of replenisher and provides constant stabilized photographic performances at a cheap cost.

In case an automatic processor is used for the continuous processing of the color photographic silver halide material (hereinafter referred to as the "color photographic material"), a method, in which while the color photographic material is processed the replenisher is added corresponding to the quantity of such material to be processed has been used. In this case, however, it is a practice at present that a very large volume of replenisher is added, most of which overflows the tank of automatic processor being discarded as waste. This poses a serious problem both in the pollution control and in the cost saving.

In recent years, in the color paper processing, the replenishing volume of color developer per 100 $cm^2$ has been reduced by the 3HC (3-Chemical High Concentration) process provided by Eastman Kodak Co. from the conventional level of about 7.5 to 4.8 cc and further by the EP-2 (Ekta Print 2) process from 4.8 to 3.2 cc. This prone toward a lower volume of replenisher (hereinafter referred to the "lower replenishment") is intended for the more effective pollution control and cost reduction (i.e., reduction in the cost of chemicals for processing) by reducing the fraction of replenisher that overflows to be discarded as the waste.

It is possible to reduce the volume of replenisher further. However, as far as the conventional method is used, it is very difficult to achieve the lower replenishment. The most important reason for it lies in a fact that the color developing agent and photographic organic reagents such as the development accelerator are less soluble in water. The bath tank is replenished with the replenisher so the ingredients comprising the color developer in the tank may be maintained individually at a constant concentration. Therefore, these ingredients must be added by the prescribed quantities regardless of the volume of replenisher used. Thus, the smaller the volume of replenisher, the thicker individual ingredients in the replenisher. Otherwise, the ingredients comprising the color developing bath can not be maintained individually at a constant level. However, since the color developing agent and photographic organic reagents such as the development accelerator are less soluble in water as mentioned above, it is very difficult to reduce the volume of replenisher in the conventional method.

There is an attempt to solve this problem by adding a concentrating agent to the color developer bath replenisher but it is not enough to solve the essential problem of the less soluble nature of the color developing agent and development accelerator themselves. Thus, it fails in providing a color developing bath replenisher having desirable concentrations of ingredients.

Another approach to this problem is to partially reuse the waste color developer, which has overflown the tank, for the purpose of the pollution control and cost reduction. In this case, however, it is necessary to use a very inefficient replenishing method in which the effective ingredients such as the color developing agent, development accelerator, and alkali are added in a form of powder or solution to the waste color developer to provide the color developer bath replenisher for recycling.

Further, if higher concentration is used for individual ingredients in the replenisher, there appears a problem of a poorer performance of the replenisher in preservation, and particularly the color developing agent during preservation at low temperatures deposit.

Further, the lower replenishment with use of a replenisher containing ingredients at high concentrations makes the concentrations of ingredients in the bath to sensitively increase or decrease in response to a slight change in the volume of replenisher. Therefore, the color photographic material to be processed shows larger fluctuations in its photographic performances, and particularly in its sensitivity and gamma.

It is thus highly desirable to provide a color development processing system with lower replenishment that is cheap in the running cost and convenient to use, requires no particular thickening of effective ingredients in the replenisher and is still capable of providing stable photographic performances.

We have studied color development processing system with use of a replenisher for color developer that contains no color developing agent or a slight quantity of such agent at most. It is possible to significantly reduce the concentration of the color developing agent in the replenisher, resulting in an improvement in the preservative performance of this replenisher. Further, since a constant quantity of color developing agent is fed from the color photographic material into the color developer bath regardless of any increase or decrease in the volume of replenisher, the photographic performances of the color photographic material have been much improved in stability.

The first object of the present invention is thus to provide a color development processing method that gives replenisher of a color developer of superior stability in preservation and is cheap in cost.

The second object of the present invention is to provide a lower replenishment color development processing method that is improved for higher photographic performances and particularly for more balanced photosensitivity and gamma in individual layers of the multi-layered color photographic material without lowering the level of sensitivity and gamma, and in addition capable of increasing the maximum concentration and decreasing the stain density.

The third object of the present invention is to provide a lower replenishment continuous color development processing method that is improved for higher stability of photographic performances, for example, their smaller fluctuations.

Other objects, features and advantages of the present invention will appear more fully from the following description.

The present invention provides a new processing method to process, after an exposure, the photographic material, which comprises at least a photosensitive silver halide emulsion layer containing a coupler laid on a support with a color developing agent and/or its precursor contained in this layer or other layer or layers, for the color development while adding replenisher for the color developer that contains 0 to 0.016 mol/1 of color developing agent.

In the present invention, it is not necessary to dissolve a large quantity of the color developing agent into the replenisher in advance, for the color photographic material contains the color developing agent or its precursor as mentioned above and therefore, the color developing agent is contained in the photosensitive material during the processing for development and particularly during the processing of a large quantity of photographic material.

The color developing agent or its precursor used in this invention can be added to the photosensitive layer of silver halide emulsion that contains a coupler, as illustrated in FIG. 1. However, it is preferable to add it to a layer different from the silver halide emulsion layer, such as the intermediate or protective layer, as illustrated in FIG. 2. Further, it is more preferable to add the precursor of the color developing agent rather than the color developing agent itself to the silver halide emulsion layer in FIG. 1 or the intermediate or protective layer in FIG. 2 since adverse effects, such as fogging, desensitization and staining, are thereby reduced.

Further, another constituent layer may be provided to add the color developing agent or its precursor. For example, the compound may be contained in a layer provided on the backside of base as illustrated in FIG. 3 or it may be added to a constituent layer that is provided on the same side as the silver halide emulsion layer without overlapping it as illustrated in FIG. 4. If the silver halide emulsion layer does not overlap the one containing the color developing agent or its precursor as in FIGS. 3 and 4, the objects of the present invention will be fulfiled fully regardless of whether the color developing agent or its precursor is used.

Namely, in the present invention, the color developing agent and/or its precursor may be contained in one or more of the following constituent layers:

(1) Silver halide emulsion layer itself,
(2) Layer laminated with the silver halide emulsion layer on the same side of a support (it is not necessary that these two layers are adjacent to each other),
(3) Layer not laminated with the silver halide emulsion layer but formed on the same side of support as the latter layer, and
(4) Layer formed on the other side of support to the silver halide emulsion layer.

The content of the color developing agent and/or its precursor used in the present invention is 0.01 to 4.0 times and preferably 0.05 to 2.0 times as much as the total silver halide content of photographic material on molar basis per unit area. It is necessary to change the concentration of the color developing agent in the replenisher of color developer according to such content of the color developing agent and/or its precursor in the color photographic material.

Further, the concentration of the color developing agent in the replenisher of color developer used in the present invention is from 0 to 0.016 mol/1, and preferably from 0 to 0.008 mol/1. It is preferable to lower the concentration of the color developing agent in the above replenisher as much as possible. Thus, the most preferable embodiment of the present invention uses an alkali solution that does not contain the color developing agent for replenishment. We confirmed that the replenishment only with an alkali solution, if achieved by the method of present invention makes the preparation and quality control of the replenisher very easy, substantially improving the efficiency of the continuous color development processing.

The color developing agent used in the color developer, the replenisher and photographic material of the present invention may be one of the known color developing agents. Preferable examples of the color developing agent are primary aromatic amines or salts of such amines with inorganic acids, such as hydrochloric acid, sulfuric acid and phosphoric acid, or salts of such amines with organic sulfonic acids of low molecular weight, such as benzenesulfonic acid and p-toluenesulfonic acid. p-phenylenediamines and p-aminophenols can be cited as typical examples of the preferable color developing agent.

Precursors of color developing agent contained in the photographic material of the present invention are, for example, Shiff bases of the U.S. Pat. No. 3,342,599 formed between primary aromatic amine developing agents and salicylaldehydes, addition products of U.S. Pat. No. 3,719,492 formed between primary aromatic amines and metal salts, such as lead and cadmium salts, precursors in a form of phthalimide of British Pat. No. 1,069,061 formed by reacting primary aromatic amines and phthalic acid, precursors of Japanese Patent Publication Open to Public Inspection No. 135,628/1978 formed by binding $\beta$-(benzenesulfonyl)ethoxycarbonyl to primary aromatic amines, precursors of Japanese Patent Publication Open to Public Inspection No. 79,035/1979 formed by binding $\beta$-cyanoethoxycarbonyl to primary organic amines, precursors of Japanese Patent Application No. 82,175/1979 formed by adding tetraphenylboron to primary aromatic amines, and precursors of Japanese patent application No. 92,014/1979 formed by adding long-chained monoalkylsulfuric acid esters to primary aromatic amines.

Further, West German Pat. Nos. 1,159,758 and 1,200,679, and U.S. Pat. No. 3,705,035 are known in this respect.

These precursors are released from the photographic material into the color developer bath as they are dissolved by alkali or their molecules are cleaved under the action of alkali. Among the color developing agents or their precursors that can be used in the present invention, it is more preferable for the objects of the invention to select those that are released in larger quantities from the photographic material into the color developer bath. Primary aromatic amine developing agents that are well suited to the objects of the present invention are expressed by the following general formula:

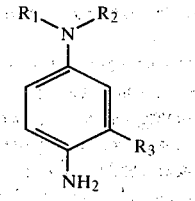

In the above formula, $R_1$, $R_2$ and $R_3$ represent individually a hydrogen atom or substituted or unsubstituted alkyl group including 1 to 4 carbon atoms.

Actual examples of the primary aromatic amine developing agent that is well suited to the objects of the present invention are given below:

| No. | Chemical formula |
|---|---|
| 1. | 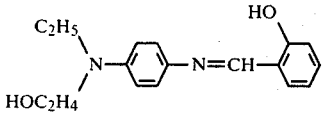 |
| 2. | 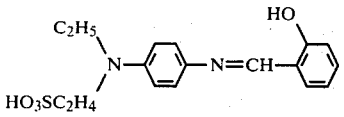 |
| 3. | 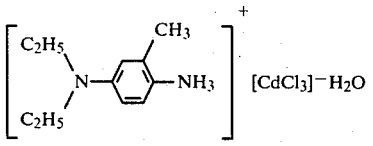 |
| 4. | 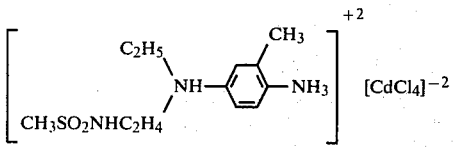 |
| 5. | 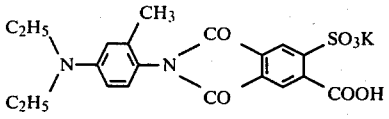 |
| 6. | 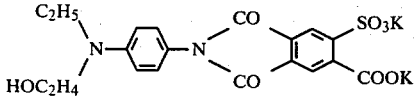 |
| 7. | 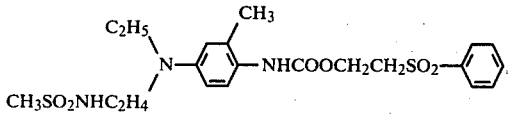 |
| 8. | 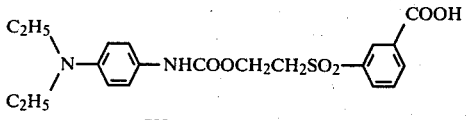 |
| 9. | 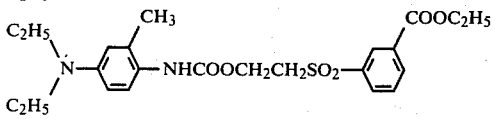 |
| 10. | 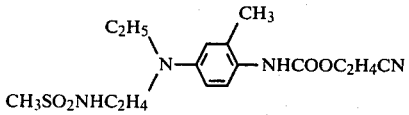 |
| 11. | 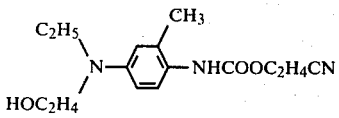 |
| 12. | 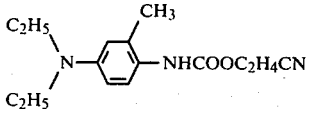 |
| 13. | 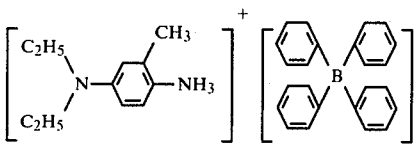 |
| 14. | 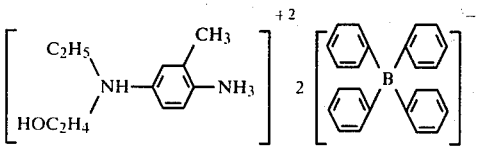 |

-continued

| No. | Chemical formula |
|---|---|
| 15. | 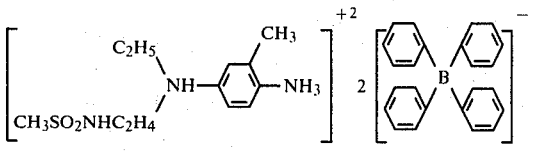 |
| 16. | 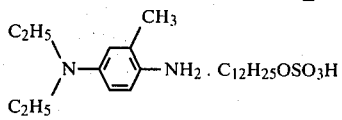 |
| 17. | 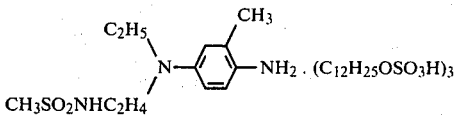 |
| 18. | 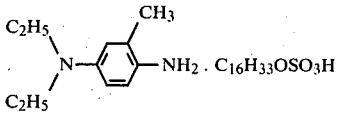 |
| 19. | 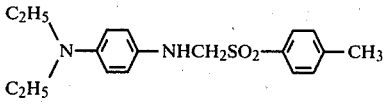 |
| 20. | 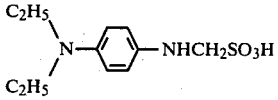 |
| 21. | 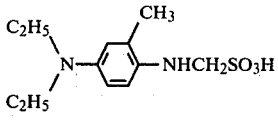 |
| 22. | 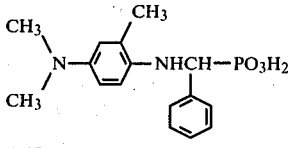 |
| 23. | 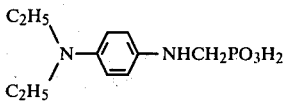 |
| 24. | 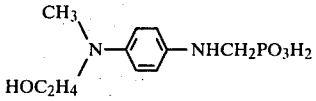 |

The color developing agent or its precursor used in this invention can be dissolved in a hydrophilic organic solvent, such as methyl alcohol, ethyl alcohol, or acetone, for direct dispersion into a hydrophilic colloid solution or it can be dispersed in a hydrophilic colloid solution using latex or some other polymer or by an oil/water emulsion type dispersion method. For the oil used in the oil/water emulsion type dispersion method, there are oils used for dissolving the coupler in the oil protect type photographic material. They are, for example, tri-o-cresyl phosphate, trihexyl phosphate, dioctyl butyl phosphate, dibutyl phthalate, diethyl laurylamide, 2,4-diarylphenol, and octyl benzoate.

To disperse the oil phase in which such agent or/its precursor is dissolved into the water phase, a usual surfactant is used. Examples of such usual surfactant are anionic surfactants containing acidic groups, such as carboxylate, sulfonate, phosphate, sulfate ester, and phosphate ester groups, nonionic surfactants, cationic surfactants and amphoteric surfactants.

For the hydrophilic colloid, gelatin and other materials that are known as the photographic binder are used. For example, use is made of gelatin derivatives, graft polymers made from gelatin and some other high polymers, cellulose derivatives, such as hydroxyethyl cellulose, carboxylmethyl cellulose, and cellulose sulfate ester, sodium alginate, derivatives of starch, and many hydrophilic synthetic polymers and copolymers such as partial acetal of polyvinyl alcohol, poly-N-vinylpyrrolidone, polyacrylic acid, polymethacrylic acid, polyacrylamide, polyvinylimidazole, and polyvinylpyrazole. Latex, may also be used. Examples are the compounds as described in U.S. Pat. No. 3,518,088 and Research Disclosure No. 148-14850 (1976).

Further, a known photographic antioxidant or stabilizer may be added to the present emulsion. For example, derivatives of hydroquinone, reductones of ascorbic acid, etc., hydroxylamines, sulfonyl compounds, and active methylene compounds may be added.

To process the photosensitive material for color development in the present invention, the conventional color developer is used. The pH of this developer is set between about 7 and 14 and preferably between about 8 and 13. The temperature of developer is selected between 20° C. and 70° C. and preferably between 25° C. and 55° C. Color developing agent is contained in the color developer in an amount of 1/500~3/100 mol/l.

For the buffering agent used in the color developer, sodium hydroxide, potassium hydroxide, sodium carbonate, potassium carbonate, tertiary sodium or potassium phosphate, potassium metaborate, borax, etc. are used singly or in combination. Further, for addition of a buffering action, convenience of preparation, or higher ionic strength, disodium or dipotassium hydrogen phosphate, sodium or potassium dihydrogen phosphate, sodium or potassium bicarbonate, boric acid, alkali nitrate, alkali sulfate and other salts may be used.

Beside, a proper quantity of a fog restrainer may be added. Examples of such fog restrainer are inorganic halides or known organic antifoggants. Beside, an arbitrary development accelrator may be added in combination as necessary.

In addition, benzyl alcohol and phenethyl alcohol as described in U.S. Pat. No. 2,304,925, and pyridine, ammonia, hydrazine, and amines are also effective development accelerators depending on purposes.

For the auxiliary developing agent, N-methyl-p-aminophenol hemisulfate (common name: Metol), benzyl-p-aminophenol hydrochloride, N,N-diethyl-p-aminophenol hydrochloride, p-aminophenol sulfate, phenidone, N,N,N',N-tetramethyl-p-phenylenediamine hydrochloride, etc. may be used. The preferable added quantity is usually between 0.01 and 1.0 g/l.

For the fogging agents, such as alkali metal polyhydride, aminoborane, or ethylenediamine, particularly, those compounds as described in Japanese Patent Publication No. 38,816/1972 may be employed in a color developer for a direct positive photographic material.

The color developer bath replenisher of the present invention may be formulated with use of the compounds as used in the above color developer.

The concentration of the color developing agent in the replenisher is 0 to 0.016 mol/l and preferably 0 to 0.008 mol/l, which changes depending on the quantity of the color developing agent or its precursor contained in the photographic material. Most preferably, the photographic material itself contains all the necessary quantity of the color developing agent and/or its precursor consumed in the color developing reaction. In this case, the concentration of the color developing agent in the replenisher may practically vanish, so the quality control of the replenisher is much simplified.

For the pH value of the replenisher of this invention, the full pH range may be used. In case of acidic pH, however, an additional labor of separately replenishing with an alkali solution is necessary. Therefore, the preferable pH range being from 8.5 to 13.0.

Replenishing amount depends on primarily color photographic material and generally is about 0.5~5.0 cc/100 $cm^2$ of color photographic material, preferably 0.8 3.0 cc/100 $cm^2$.

The color developing agent or its precursor used in the photosensitive material of the present invention may be applied both to the general color photographic material, such as the nega color film, color paper, positive color film, and color reversal film, and to the direct positive type color photographic material.

Further, such color developing agent or its precursor may also be applied to the black and white photosensitive halide material together with the coupler for the black dye formation. In this case, a reduction in the quantity of silver halide may be achieved.

The photographic material of the present invention contains in the layer of photosensitive emulsion a so-called coupler or a compound that reacts with the oxidized color developing agent to form a dye. This coupler has a molecular structure that prevents it from dispersing into other layer or layers during the manufacturing process or processing process.

For the yellow coupler, generally, open-chained diketomethylene compounds are widely used. Examples are given in U.S. Pat. Nos. 3,341,331, 2,875,057 and 3,551,155, West Germany OLS Pat. No. 1,547,868, U.S. Pat. Nos. 3,265,506, 3,582,322, and 3,725,072, West Germany OLS Pat. No. 2,162,899, U.S. Pat. Nos. 3,369,895 and 3,408,194, West Germany OLS Pat. Nos. 2,057,941, 2,213,461, 2,219,917, 3,261,361, and 2,263,875.

For the magenta coupler, 5-pyrazolone compounds are primarily used through indazolone compounds and cyanoacetyl compounds may also be used. Examples are given in U.S. Pat. Nos. 2,439,098, 2,600,788, 3,062,653 and 3,558,319, British Pat. No. 956,261, U.S. Pat. Nos. 3,582,322, 3,615,506, 3,519,429, 3,311,476, and 3,419,391, Japanese Patent Application Nos. 21,454/1966 and 56,050/1973, West German Pat. No. 1,810,464, Japanese Patent Publication No. 2,016/1969, Japanese patent application No. 45,971/1973, U.S. Pat. No. 2,983,608, etc.

For the cyan coupler, derivatives of phenol or naphthol are primarily used. Examples are given in U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892, and 3,583,971, West German OLS Patent No. 2,163,811, Japanese patent publication No. 28,836/1970, Japanese patent publication No. 33,238/1973, etc.

In addition, a development inhibitor releasing coupler (so-called DIR coupler) or a compound capable of releasing a development inhibitor during the color development reaction may be added.

For the above DIR coupler or the like, two types may by used in the same layer to satisfy the characteristic requirements for the photosensitive material. It is a matter of course that the same compound is used in 2 or more different layers.

Further, the photographic material of the present invention may contain a black dye forming coupler as disclosed in West Germany OLS Pat. No. 2,644,194 and Japanese Patent Application No. 70,471/1978.

The halide emulsion used in the photographic material of the present invention is prepared by an ordinary method, which may be formulated using any of silver chloride, bromide, chlorobromide, iodobromide, and chloroiodobromide. Such halide emulsion may be chemically sensitized by an ordinary method. Further, a photosensitive dye, antifoggant, hardening agent, plasticizer, surfactant, and other additives of common use may be added to such emulsion.

For the base used to support layers in the photosensitive material of the present invention, cellulose film, plastic film, as well as glass, paper, laminated products, and further polymer-laminated paper are useful.

An antifoggant to suppress fogging of the halide may be added in the photosensitive layer of the photosensitive material. Typical examples of the useful antifoggant are heterocyclic organic compounds, such as tetrazole, azaindene, and triazole, and aromatic or heterocyclic compounds having a mercapto group or groups.

The layers of the photosensitive material of the present invention may contain a hardening agent, plasticizer, lubricant, surfactant, brightener, and other additives that are usually used in the technical field of photography.

In the photographic emulsion, cyanine dyes, such as cyanine, merocyanine, hemicyanine, may be used singly or in combination with themselves or styryl dyes for spectral sensitization or supersensitization as necessary.

The photographic emulsion as mentioned above is coated on a plane material that shows no remarkable changes in dimensions during processing.

The invention will now be described more fully referring to the following examples.

EXAMPLE 1

A surface of a resin-coated paper base was coated with the following layers, successively in the order of description, to prepare Samples I and II.

Preparation of Sample I

Layer 1—Layer of yellow color forming blue-sensitive halide emulsion.

A coupler α-(1-benzyl-2,4-dioxo-3-imdazolidinyl)-α-bivalyl-2-chloro-5-[α(2,4-di-t-amylphenoxy)-butylamido]acetoanilide is dissolved in dibutylphthalate (hereinafter called "DBP") and then dispersed in an aqueous gelatine solution. The dispersed solution was added to a chloroiodobromide emulsion containing 1 mol% of iodide and 80 mol% of bromide. The coating was conducted to a thickness that corresponded to a quantity of silver and coupler of 420 mg/m$^2$ and 562 mg/m$^2$, respectively.

Layer 2—Intermediate layer (gelatine layer 1μ thick).

Layer 3—Layer of green-sensitive halide emulsion.

A magenta coupler 1-(2,4,6-trichlorophenyl)-3-(2-chloro-5-octadecylsuccinimidoanilino)-5-pyrazolone is dissolved in tricresy phosphate (hereinafter called "TCP") and then dispersed in an aqueous gelatine solution. The dispersed solution was added to a chlorobromide emulsion containing 30 mol% of bromide. The coating was conducted to a thickness that corresponded to a quantity of silver and coupler of 580 mg/m$^2$ and 684 mg/m$^2$, respectively.

Layer 4—Intermediate layer (gelatine layer 1μ thick).

Layer 5—Layer of cyan color forming red-sensitive halide emulsion.

A cyan coupler 2,4-dichloro-3-methyl-6-[α(2,4-di-t-amylphenoxy)butylamido]phenol was dissolved in TCP and then dispersed in an aqueous gelatine solution. The dispersed solution was added to a chlorobromide emulsion containing 80 mol% of bromide. The coating was conducted to a thickness that corresponded to a quantity of silver and coupler of 520 mg/m$^2$ and 458 mg/m$^2$, respectively.

Layer 6—Protective layer (gelatine layer 1μ thick).

Each of Layers 1, 3 and 5 contained a stabilizer sodium salt of 4-hydroxy-6-methyl-1,3,3a,7-tetraazaindene, a hardening agent bis(vinylsulfonylmethyl)ether, and a coating aid saponin.

Preparation of Sample II

A compound No. 13 was dissolved in dioctylphthalate and then dispersed in an aqueous gelatine solution. The dispersed solution was added to the emulsions prepared for Layers 4 and 6 of Sample I and the coating was made with these emulsions to provide Layers 4 and 6 of Sample II in a thickness corresponding to a quantity of the compound of 250 mg/m$^2$. Other layers were formed just in the same method as applied to Sample I.

Strips, each 10,000 m long and 82 mm wide, were cut from both of Samples I and II. A camera was loaded with a color nega film for shooting at ASA 100. The film was processed for color development. Using the developed negative, the cut s-rips were uniformly exposed to the shot image in an automatic color printer and processed using an automatic processor as follows:

Color developing (2½ min)—Bleach-fixing (1½ min)—Washing (3½ min)—Drying.

The processing temperature was set to 33° C. at individual steps while the processing aqueous solutions were formulated as follows:

Formulation of the color developer (aqueous):

| Compound | Concentration (g/l) | | |
|---|---|---|---|
| | Tank solution | Replenishing solution I | Replenishing solution II |
| Potassium carbonate | 26 | 30 | 30 |
| Aqueous 60% 1-hydroxy-ethylidene-1,1-diphosphonic acid | 0.9 | 1.1 | 1.1 |
| Potassium sulfite | 20 | 2.5 | 2.5 |
| Ethylene glycol | 16 | 20 | 20 |
| Brightening agent-derivative of 4,4'-diaminostilbenephosphonic acid | 1.6 | 2.0 | 2.0 |
| Hydroxylamine sulfate | 3.2 | 4.0 | 4.0 |
| Potassium bromide | 0.64 | 0 | 0 |
| Potassium chloride | 0.50 | 0 | 0 |
| 4-amino-3-methyl-N,N-diethylaniline hydrochloride | 2.7 | 2.7 | 0 |
| pH (adjusted with potassium hydroxide) | | 10.20 | 10.40 |

The replenishing solution was added 26.5 ml per 1 m of sampel strip. The tank solution in the above table corresponded to a solution with which the automatic processor was filled from the beginning (the same applies hereinafter).

The replenishing solutions I and II were used for the continuous processing of Samples I and II, respectively, for color development. It is noted that the replenishing solution II did not contain the color developing agent 4-amino-3-methyl-N,N-diethylaniline hydrochloride at all.

Formulation of bleach-fix bath (aqueous):

| Compound | Concentration (g/l) in tank solution & replenishing solution |
|---|---|
| Ethylenediaminetetraacetic acid ferric ammonium salt | 65 |
| Aqueous 50% ammonium sulfite | 15 |
| Aqueous 60% ammonium thiosulfate | 160 |
| Ethylenediaminetetraacetic acid sodium salt | 40 |
| pH (adjusted with ammonia water) | 7.1 |

The replenishing solution of the above formulation was added 26.5 ml per 1 m of sample strip.

Washing:

8.28 ml of water was run per 1 m of sample strip.

To see the photographic performances, the wedge exposed parts of the above Samples I and II were processed at the start and at the end of 10,000 m processing, respectively.

The processed samples were compared in Table 1 for fogging, relative sensitivity and maximum development density in yellow (Y), magenta (M) and cyan (C). The relative sensitivity was estimated by comparison to the sample I processed at the start of processing whose sensitivity in Y, M and C was taken 100, respectively.

It is found from Table 1 that there was more fogging in Sample I at the end than at the start of processing. The replenishing solution I used for the continuous processing of Sample I was nearly saturated with the color developing agent 4-amino-3-methyl-N,N-diethylaniline hydrochloride, which separated gradually in a oily form as the solution was left to stand at ambient temperature several days or several weeks after it preparation. The separated oily color developing agent was liable to air oxidation being gradually darkened. It was found that there was more fogging in Sample I as the above changes gradually proceeded. Further, a slight desensitization was also detected.

TABLE 1

| | Processing timing | Fogging | | | Relative sensitivity | | | Maximum color density | | |
|---|---|---|---|---|---|---|---|---|---|---|
| | | Y | M | C | Y | M | C | Y | M | C |
| Sample I (not covered by the invention | At start | 0.06 | 0.07 | 0.06 | 100 | 100 | 100 | 2.45 | 2.44 | 2.46 |
| | At end | 0.17 | 0.19 | 0.14 | 94 | 96 | 97 | 2.42 | 2.39 | 2.43 |
| Sample II (covered by the invention | At start | 0.06 | 0.07 | 0.06 | 100 | 100 | 100 | 2.47 | 2.46 | 2.46 |
| | At end | 0.06 | 0.07 | 0.06 | 99 | 101 | 100 | 2.47 | 2.45 | 2.45 |

By contrast, the replenishing solution II used for the continuous processing of Sample II contained no color developing agent, so it did not show such separation of dark oily color developing agent as observed with the replenishing solution I. Thus, the replenishing solution II could always be kept at a transparent state even during a long term storage. As a result, the photographic performances exhibited at the start of processing Sample II differed almost nothing from those at the end of such processing and it was found that a practically constant level of photographic performances were always available.

EXAMPLE 2

Successive layers were formed as in Example 1 but for Layer 4 to which the compound No. 13 was added to a quantity of 250 mg/m$^2$. Sample III was thus prepared.

Strips, 10,000 m long and 82 mm wide, were cut from Sample III and exposed just in the same way as in Example 1. The replenishing solution III used for the continuous processing of Sample III was formulated as follows:

Formulation of the replenishing solution III:

| Compound | Concentration (g/l) |
|---|---|
| Potassium carbonate | 30 |
| Aqueous 60% 1-hydroxyethylidene-1,1-diphosphonic acid | 1.1 |
| Potassium sulfite | 2.5 |
| Ethylene glycol | 20 |
| Brightening agent - derivative of 4,4'-diaminostilbenediphosphonic acid | 2.0 |
| Hydroxylamine sulfate | 4.0 |
| Potassium bromide | 0 |
| Potassium chloride | 0 |
| 4-amino-3-methyl-N,N-diethylaniline hydrochloride | 1.4 |
| pH (adjusted with potassium hydroxide) | 10.40 |

The replenishing quantity was just the same as in Example 1.

The bleach-fix bath was also prepared in the same formulation as the one used in Example 1.

The replenishing solution III contained the color developing agent at a concentration substantially below the saturation level, so any separation of dark oily color dveloping agent as observed in the replenishing solution I was not identified. Therefore, like Sample II, Sample III also gave favorable results.

EXAMPLE 3

Preparation of Sample IV:

A transparent cellulose triacetate film base was undercoated to give a hydrophilic property. The base was then successively coated with layers A to H of hydrophilic colloids as described below in the order of description and dried to give a multi-layered color nega photosensitive material:

Layer A—Antihalation layer

The base was coated with a gelatine solution in which grey colloidal silver was dispersed to a thickness corresponding to 1.8 g/m$^2$ of gelatine and 250 mg/m$^2$ of grey colloidal silver.

Layer B—Intermediate layer

An intermediate gelatine layer was formed by coating next to the antihalation layer to a thickness corresponding to a quantity of gelatine of 1.2 g/m$^2$.

Layer C—Cyan color forming layer

A cyan colorless coupler 1-hydroxy-N-[α-2,4'-di-tert-amylphenoxy)butyl]-2-naphthoamide, cyan colored coupler 1-hydroxy-4-(2'-acetyl-phenylazo)-N-[α-2'', 4''-di-tert-amylphenoxy)butyl]-2-naphthamide, and DIR compound 2-(1-phenyl-5-tetraazolylthio)-4-(2,4-di-t-amylphenoxyacetamide)-1-iredanone were dissolved in a coupler solvent that was made red-sensitive by the use of a panchrmoatic sensitizing dye and composed of tri-o-cresyl phosphate. The solution was dispersed in gelatine solution using an anionic surfactant as the dispersing aid to give a photosensitive iodobromide gelatine emulsion. The coating was conducted to a thickness corresponding to 4.0 g gelatin, 3.5 g silver, 1.1 g colorless coupler, 0.32 g colored coupler, and 0.11 g DIR compound per 1 m$^2$.

Layer D—Intermediate layer 2,5-di-sec-dodecyl-hydroquinone, a compound to inhibit any interlayer diffusion of the oxidation products of the color developing agent was dissolved in di-n-butyl phthalate and then dispersed in gelatine solution. The coating was made next to the cyan color forming layer to a thickness corresponding to a quantity of gelatine of 1.2 g/m$_2$ and diffusion inhibitor compound of 0.15 g/m$^2$.

Layer E—Magenta color forming layer

A magenta colorless coupler 1-(2,4,6-trichlorophenyl)-3-3-]-(2,4-di-tert-amylphenoxy-acetamido]benzamido-5-pyrazolone, magenta colored coupler 1-(2,4,6-trichlorophenyl)-3 3-[-(2,4-di-tert-amulphenoxy)acetamido]benzamido-4-(p-methoxyphenylazo)-5-pyrazolone and DIR compound 2-(1-phenyl-5-tetraazolylthio)-4-(2,4-di-t-amylphenoxyacetamido)-1-indanone were dissolved in a coupler solvent that was made green-sensitive by the use of an orthochromic sensitizing dye and composed of tri-o-cresyl phosphate. The solution was dispersed in gelatine solution using a dispersing aid to give a photosensitive iodobromide emulsion. The coating was conducted to a thickness corresponding to 4.0 g of gelatine, 3.0 g of silver, 1.1 g of cololess coupler, 0.37 g of colored coupler and 0.11 g of DIR compound per 1 m$^2$.

Layer F—Yellow filter layer.

Using a gelatine emulsion, in which yellow colloidal silver and 2,5-di-sec-dodecyl-hydroquinone, a compound to prevent any interlayer diffusion of the oxidized form of color developing agent and to inhibit any staining due to such oxidation products, dissolved in di-n-butyl phosphate were dispersed, the coating was made to a thickness corresponding to 1.5 g of gelatine, 0.10 g of yellow colloidal silver and 0.2 g of hydroquinone derivative per 1 m$^2$.

Layer G—Yellow color forming layer.

A yellow coupler 3-benzoylacetamino-4-methoxy-(2,'4'-di-tert-amylphenoxy)acetanilide was dissolved in di-n-butyl phthalate and then dispersed in a blue-sensitive iodobromide emulsion. The coating was conducted to a thickness corresponding to 3.5 g of gelatine, 1.5 g of silver and 2.5 g of yellow coupler per 1 m$^2$.

Layer H—Protective layer.

The coating was made with gelatine solution to a thickness corresponding to a quantity of gelatine of 1.2 g/m$^2$.

Each of Layers A to H contained a coating aid and gelatine hardening agent.

Preparation of Sample V:

After preparation of Sample IV, the other side of the cellulose triacetate film base that was opposite to the emulsion layers was undercoated to give a hydrophilic property. It was then successively coated with Layers I and J of hydrophilic colloid as described below in the order of description and dried to give Sample V.

Layer I—Layer containing a color developing agent.

A color developing agent 3-methyl-4-amino-N-ethyl-N-(-hydroxyethyl)aniline sulfate was dissolved in a gelatine solution and the pH was adjusted to 5.5. The coating was made to a thickness corresponding to 5.0 g of gelatine and 4.7 g of color developing agent per 1 m$^2$.

Layer J—Protective layer.

The coating was made with gelatine solution to a thickness corresponding to a quantity of gelatine of 1.2 g/m$^2$.

The above Samples IV and V were cut 35 mm wide. The image shooting was made at an exposure condition of ASA 100. Individual sample strips 10,000 m long were processed as specified below in the automatic processor while making up the processing solution for development. It is noted that the replenishing solutions IV and V were those used in the continuous color development of Samples IV and V, respectively, the latter replenishing solution not containing the color developing agent 4-amino-3-methyl-N-ethyl-N-(-hydroxyethyl-)aniline sulfate at all.

Processing condition:

Color development (3¼ min)—Bleaching (6½ min-)—First washing (3¼ min)—Fixing (6½ min)—Second washing (3¼ min)—Stabilization (1½ min).

The processing temperature was set to 38° C. at individual steps and the processing solutions used were formulated as follows:

Formulation of the color developing solution (aqueous):

| Compound | Concentration (g/l) Tank solution | Replenishing solution IV | Replenishing solution V |
|---|---|---|---|
| Potassium carbonate | 30 | 36 | 36 |
| Potassium sulfite | 3 | 5 | 5 |
| Sodium bromide | 1.2 | 0 | 0 |
| Potassium iodide | 0.002 | 0 | 0 |
| Hydroxylamine sulfate | 3 | 4.3 | 4.3 |
| 3-methyl-4-amino-N-ethyl-N-(-hydroxyethyl)aniline sulfate | 4.8 | 7.5 | 0 |
| pH (adjusted with potassium hydroxide) | 10.02 | 10.28 | 10.28 |

The above replenishing solution was added 22 ml per 1 m of sample strip.

Formulation of the bleaching solution (aqueous):

| Compound | Concentration (g/l) in tank solution & replenishing solution |
|---|---|
| Ethylenediaminetetraacetic acid ferric ammonium salt | 100 |
| Ethylenediaminetetraacetic acid ferrous diammonium salt | 10 |
| Ammonium bromide | 150 |
| Glacial acetic acid | 10 |

-continued

| Compound | Concentration (g/l) in tank solution & replenishing solution |
|---|---|
| pH (adjusted with ammonia water) | 6.0 |

The above replenishing solution was added 35 ml per 1 m of sample strip.

First washing:

900 ml of water was run per 1 m of sample strip. Formulation of the fixing solution (aqueous):

| Compound | Concentration (g/l) |
|---|---|
| Ammonium thiosulfate | 85 |
| Anhydrous sodium sulfite | 6.0 |
| Sodium metasulfite | 2.8 |
| pH (adjusted with acetic acid) | 6.0 |

Second washing:

900 ml of water was run per 1 m of sample strip. Formulation of the stabilizing solution (aqueous):

| Compound | Concentration (g/l) in tank solution & replenishing solution |
|---|---|
| Aqueous 37% formalin | 5 |
| Polyethylene glycol p-tert-octylphenyl ether | 0.5 |

To see the photographic performances, the wedge exposed parts of the above Samples IV and V were processed at the start and at the end of 10,000 m processing, respectively. Both the Samples IV and V gave the same nega image at the start as at the end of 10,000 m processing. It is noted that the replenishing solution IV had such a defect that the color developing agent separated from the solution if it was not prepared by first dissolving the agent in water and then carefully adding the dissolved agent to the alkali solution. When prepared, the replenishing solution V was completely free of the above defect. Further, the quality control was quite simplified with the replenishing solution V than with the solution VI since the former solution was less liable to changes in pH.

Figure 1:
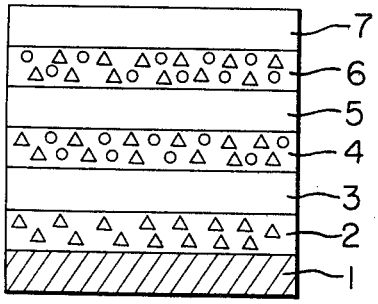
FIGS. 1 to 4 are the cross section of the color photosensitive halide materials used in the processing method embodying the present invention, wherein the numbers and symbols are used in the following meanings.
Figure 2:
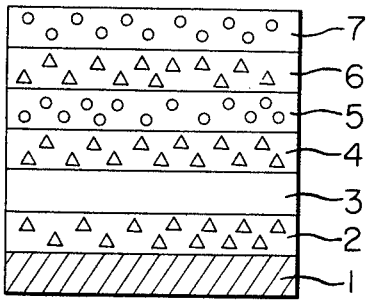
Figure 3:
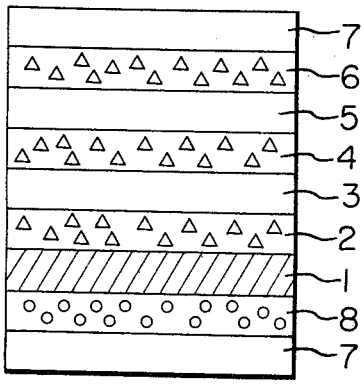
Figure 4:
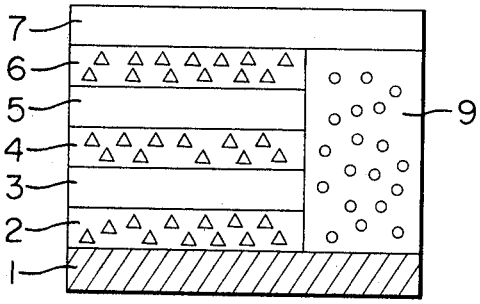

1—Base, 2—Photosensitive silver halide emulsion layer, 3—Intermediate Layer, 4—Layer containing photosensitive silver halide emulsion, 5—Intermediate layer, 6—Layer containing photosensitive silver halide emulsion, 7—Protective layer, 8—Layer containing a color developing agent, 9—Layer containing a precursor of a color developing agent. △Silver halide grain. ○A color developing agent or a precursor thereof.

What is claimed is:

1. A method for processing an exposed color photographic material which comprises on a support (1) at least one of hydrophilic coloidal layer one of which layer containing a silver halide emulsion and a coupler, and (2) a color developing agent or a precursor thereof in the hydrophilic layer, wherein the exposed color photographic material is developed in a color developer containing a color developing agent which color developer is replenished with a replenisher containing 0 to 0.016 mol/l of a color developing agent.

2. A method according to claim 1 wherein the color photographic material contains a color developing agent or precursor thereof in an amount at 0.01 to 4.0 times of as much as the silver halide on molar basis.

3. A method according to claim 1 wherein the color developing agent or precursor thereof is contained in a layer located adjacent to the layer containing a silver halide emulsion and a coupler.

4. A method according to claim 1 wherein the color developer is replenished at a rate of 0.5 to 5.0 cc/100 $cm^2$ of the color photographic material.

* * * * *